United States Patent [19]

Hammond et al.

[11] 4,338,206

[45] Jul. 6, 1982

[54] QUATERNARY AMMONIUM SUCCINIMIDE SALT COMPOSITION AND LUBRICATING OIL CONTAINING SAME

[75] Inventors: Kenneth G. Hammond; Harry Chafetz, both of Poughkeepsie, N.Y.

[73] Assignee: Texaco Inc., White Plains, N.Y.

[21] Appl. No.: 246,512

[22] Filed: Mar. 23, 1981

[51] Int. Cl.[3] ..... C10M 1/32

[52] U.S. Cl. ..... 252/34; 252/51.5 A; 546/281

[58] Field of Search ..... 252/34, 51.5 A; 546/281

[56] References Cited

U.S. PATENT DOCUMENTS

| | | | |
|---|---|---|---|
| 3,039,860 | 6/1962 | Andress, Jr. et al. | 252/34 X |
| 3,135,765 | 6/1964 | Andress, Jr. et al. | 252/34 X |
| 3,224,968 | 12/1965 | Hinkamp | 252/34 X |
| 3,235,556 | 2/1966 | Wakeman et al. | 252/34 X |
| 3,723,460 | 3/1973 | Brannen et al. | 252/34 X |
| 3,778,371 | 12/1973 | Malec | 252/34 |
| 3,950,341 | 4/1976 | Okamoto et al. | 252/34 X |
| 4,108,858 | 8/1978 | Malec | 252/34 X |
| 4,248,719 | 2/1981 | Chafetz et al. | 252/34 |
| 4,251,380 | 2/1981 | Hammond et al. | 252/34 |
| 4,253,980 | 3/1981 | Hammond et al. | 252/34 |

*Primary Examiner*—Andrew Metz

*Attorney, Agent, or Firm*—Carl G. Ries; Robert A. Kulason; James J. O'Loughlin

[57] ABSTRACT

A quaternary ammonium succinimide salt composition represented by the formula:

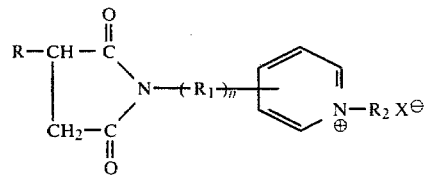

in which R is a hydrocarbyl radical having from 25 to 200 carbon atoms, $R_1$ is a divalent hydrocarbon radical having from 1 to 10 carbon atoms, $R_2$ is a hydrocarbyl radical having from 1 to 10 carbon atoms, n has a value of 0 or 1, and X is a halide radical is provided, as well as a method of preparation and a lubricating oil composition containing same.

11 Claims, No Drawings

QUATERNARY AMMONIUM SUCCINIMIDE SALT COMPOSITION AND LUBRICATING OIL CONTAINING SAME

BACKGROUND OF THE INVENTION

1. Field of the Invention

Internal combustion engines operate under a wide range of temperatures including low-temperature stop-and-go service as well as high-temperature conditions produced by continuous high speed driving. Stop-and-go driving, particularly during cold, damp weather conditions, leads to the formation of sludge in the crankcase and in the oil passages of a gasoline engine. This sludge seriously limits the ability of the crankcase oil to lubricate the bearings and sliding wear surfaces in the engine or to act as a coolant. In addition, the sludge serves to contribute to rust formation within the engine because it tends to retain water in areas susceptible to corrosion. The noted problems are compounded by lubrication service maintenance recommendations calling for extended oil drain intervals.

It is known to employ nitrogen-containing dispersants and/or detergents in the formulation of crankcase lubricating oil compositions. Many of the known dispersant/detergent compounds are based on the reaction of an alkenylsuccinic acid or anhydride with an amine or polyamine to produce an alkenylsuccinimide or an alkenylsuccinamic acid as determined by selected conditions of reaction.

It is also known to chlorinate alkenylsuccinic acid or anhydride prior to the reaction with an amine or polyamine in order to produce a reaction product in which a portion of the amine or polyamine is attached directly to the alkenyl radical of the alkenylsuccinic acid or anhydride. The thrust of many of these processes is to produce a dispersant reaction product typically containing from about 0.5 to 5% nitrogen. These dispersant additives exhibited a high degree of oil solubility and have been found to be effective for dispersing the sludge that is formed under severe low temperature stop-and-go engine operating conditions. However, it has become increasingly difficult to formulate lubricants with these additives which meet the present requirements with respect to the prevention or inhibition of the formation of varnish.

2. Description of the Prior Art

A copending application, Ser. No. 224,728, filed on Jan. 13, 1981, discloses a quaternary ammonium succinimide salt composition formed from an N-(haloalkyl)hydrocarbylsuccinimide and a heteroaromatic amine and lubricants containing same.

A copending application, Ser. No. 246,513, filed on Mar. 23, 1981, discloses a quaternary ammonium succinimide salt composition prepared from a hydrocarbylsuccinimide derived haloamide.

SUMMARY OF THE INVENTION

The quaternary ammonium succinimide salt composition of this invention is represented by the formula:

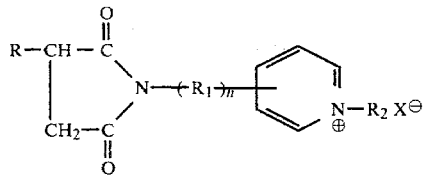

in which R is a hydrocarbyl radical having from 25 to 200 carbon atoms, $R_1$ is a divalent hydrocarbon radical having from 1 to 10 carbon atoms, $R_2$ is a hydrocarbyl radical having from 1 to 10 carbon atoms, n has a value of 0 or 1, , and X is a halide radical.

The novel quaternary ammonium succinimide salt composition of the invention is prepared stepwise by reacting a hydrocarbon-substituted succinic anhydride with the prescribed amino group bearing pyrridine derivative to produce an intermediate succinimide compound, and then reaction of the intermediate with a hydrocarbyl halide to form the prescribed quaternary ammonium salt dispersant of the invention.

The lubricating oil composition or lubricant concentrate of the invention comprises a substrate of lubricant viscosity and an effective dispersant amount of the prescribed quaternary ammonium succinimide salt of the invention.

DESCRIPTION OF THE PREFERRED INVENTION

The novel quaternary ammonium succinimide salt composition of the invention is represented by the formula:

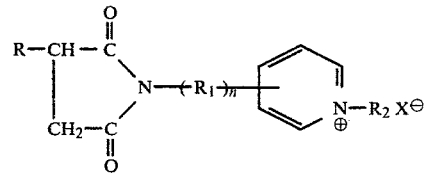

in which R, $R_1$, $R_2$, n, and X have values indicated hereinabove. Hydrocarbyl is defined as a saturated or unsaturated monovalent hydrocarbon radical.

A preferred quaternary ammonium succinimide salt composition of the invention is one in which R is an alkenyl radical, such as a polybutenyl, polyisobutenyl, and polypropenyl radical, having from about 50 to 125 carbon atoms, $R_1$ is methylene, n is 0 or 1, $R_2$ is a benzyl radical and X is a chloride radical.

The preparation of the quaternary ammonium succinimide salt composition of the invention begins with a hydrocarbylsuccinic anhydride. This starting reactant is represented by the formula:

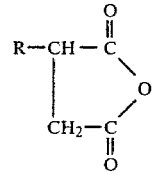

in which R has the value noted above. The method for preparing hydrocarbylsuccinic anhydrides is well known in the art and does not constitute a part of this invention.

The hydrocarbylsuccinic anhydride is reacted with a prescribed amino group bearing pyridine derivative to produce an intermediate hydrocarbylsuccinimide. Amino group bearing pyridine derivatives which can be employed in this reaction are represented by the formula:

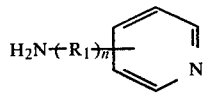

in which $R_1$ is a divalent hydrocarbon radical having from 1 to 10 carbon atoms and n has a value of 0 or 1. Typical amino group bearing pyridine derivatives which are useful for preparing effective dispersants of this invention include 3-aminopyridine, 4-aminopyridine, 2-aminomethylpyridine, 3-aminomethylpyridine, 4-aminomethylpyridine, 2-(2-aminoethyl)pyridine, 3-(2-aminoethyl)pyridine, and 4-(2-aminoethyl)pyridine. In contrast to the prescribed amino group bearing pyridine derivatives, the quaternary ammonium compounds prepared from 2-aminopyridine are relatively ineffective.

In general, the synthesis of the pyridine substituted succinimide, which can be represented by the formula:

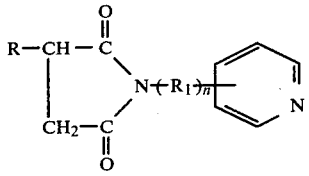

in which R, $R_1$ and n have the value noted above, is conducted by dissolving the hydrocarbylsuccinic anhydride and the amino group bearing pyridine derivative in an inert solvent, such as a hydrocarbon solvent (i.e. heptane, benzene, toluene, xylene, etc.) and refluxing the mixture until the conversion to the succinimide is essentially complete. This reaction is conveniently conducted at an elevated temperature, preferably at the reflux temperature of the solvent employed for a sufficient length of time to effect the desired succinimide formation. After product formation, the solvent is removed by distillation.

The following examples illustrate the method for preparing the intermediate pyridine substituted succinimide.

EXAMPLE I

A solution containing polyisobutenyl (1300 MW) succinic anhydride (350 g, 61 sap. no., 0.19 mole), 3-aminopyridine (17.8 g, 0.19 mole), and toluene (500 Ml) was stirred under reflux (approximately 110° C.) for 6.0 hr. The mixture was stripped to 90° C. (15 mm Hg) to yield 364 g of 3-(polyisobutenylsuccinimido)pyridine, 1.4% N (1.4% N calculated.)

EXAMPLE II

A solution containing polyisobutenyl (1300 MW) succinic anhydride (555 g, 64 sap no., 0.32 mole), 3-aminomethylpyridine (36.0 g, 0.33 mole) and toluene (300 Ml) was stirred under reflux (approximately 110° C.) for 6 hr. The mixture was stripped to 90° C. (15 mm Hg) to yield 585 g of 3-(polyisobutenylsuccinimidomethyl)pyridine, 1.3% N (1.6% N calculated).

In the final step of the reaction, the pyridine substituted succinimide is reacted with a hydrocarbyl halide in order to form the prescribed quaternary ammonium succinimide salt composition. The effective hydrocarbyl halide is represented by the formula:

$$R_3—X$$

in which $R_3$ is an alkyl group such as a methyl, ethyl, 1-propyl, 2-propyl, 1-butyl, 2-butyl, 2-methyl-1-propyl, 1-pentyl, 2-pentyl, or 3-pentyl radical, an alkenyl group such as an allyl or a 2-methylallyl radical, or an aralkyl group such as a benzyl, 1-phenethyl or a 2-phenethyl radical, and X is a chlorine, bromine, or iodine radical. Examples of suitable hydrocarbyl halides include methyl chloride, methyl bromide, methyl iodide, ethyl chloride, ethyl bromide, ethyl iodide, 1-chloropropane, 2-chloropropane, 1-bromopropane, 2-bromopropane, 1-iodopropane, 2-iodopropane, allyl chloride, allyl bromide, allyl iodide, benzyl chloride, benzyl bromide, benzyl iodide, 1-phenethyl chloride, 1-phenethyl bromide, 1-phenethyl iodide, 2-phenethyl chloride, 2-phenethyl bromide and 2-phenethyl iodide.

In general, the quaternary salt reaction product is prepared by admixing the pyridine substituted succinimide and the hydrocarbyl halide. The reactants are stirred or agitated at an elevated temperature for sufficient time to effect the formation of the desired quaternary ammonium hydrocarbon substituted succinimide.

The following examples illustrate the method for preparing the quaternary ammonium succinimide salt composition of the invention.

EXAMPLE III

A solution containing 3-(polyisobutenylsuccinimido) pyridine (200 g) prepared according to Example I and benzyl chloride (50 g) was stirred at 140°–145° C. for 8 hr and then stripped to 93° C. (0.2 mm Hg) to yield a sample of benzyl 3-(polyisobutenylsuccinimido)-pyridinium chloride analyzing 1.0% N (1.4% N calculated), and which appeared to be contaminated with a small amount of unreacted halide. A portion of the stripped product was dissolved in heptane and extracted with methanol to remove unreacted halide and low molecular weight impurities from the product. The heptane was stripped to yield a quaternary ammonium salt having 0.94% N (1.4% N calculated) and 1.2% Cl (1.7% calculated).

EXAMPLE IV

A solution containing 3-(polyisobutenylsuccinimido) pyridine (88 g) prepared according to Example I and benzyl chloride (88 g) was stirred at 140°–145° C. for 18 hr. The product, benzyl 3-(polyisobutenylsuccinimido)-pyridinium chloride, was isolated as described in Example III.

EXAMPLE V

A solution containing 3-(polyisobutenylsuccinimidomethyl)pyridine (200 g) prepared according to Example II and benzyl chloride (50 g) was stirred at 140° C. for 8 hr. The product, benzyl 3-(polyisobutenylsuccinimidomethyl)pyridinium chloride, was isolated as described in Example III.

The following quaternary ammonium succinimide salt compositions can also be prepared according to the experimental procedure described in the examples: benzyl 4-(polyisobutenylsuccinimido)pyridinum chloride, benzyl 3-(polyisobutenylsuccinimido)pyridinium bromide, benzyl 3-(polyisobutenylsuccinimido)pyridinium iodide, benzyl 2-(polyisobutenylsuccinimidomethyl)-pyridinium chloride, benzyl 4-(polyisobutenylsuccinimidomethyl)pyridinium chloride, benzyl 2-(2-polyisobutenylsuccinimidomethyl)pyridinium chloride, benzyl 3-(2-polyisobutenylsuccinimidoethyl)pyridinium chloride, benzyl 4-(2-polyisobutenylsuccinimidoethyl)-pyridinium chloride, butyl 3-(polyisobutenylsuccinimido)pyridinium chloride, propyl 3-(polyisobutenylsuccinimido)pyridinium chloride, ethyl 3-(polyisobutenylsuccinimido)pyridinium chloride, and methyl 3-(polyisobutenylsuccinimido)pyridinium chloride wherein the polyolefin or polyisobutylene radical has an average molecular weight ranging from about 350 to 2800.

The lubricant composition of the invention comprises a major amount of a mineral hydrocarbon oil or synthetic oil of lubricating viscosity and an effective detergent-dispersant amount of the prescribed quaternary ammonium salt. Advantageously, in the finished lubricating salt oil composition, the prescribed quaternary ammonium salt content ranges between about 0.1 and 10 percent by weight, preferably between about 0.5 and 5 weight percent. In the lubricating oil, concentrates, from which the finished lubricating compositions are derived via the addition of added lubricating oil, quaternary ammonium salt contents between about 10 and 50 weight percent are found. Thus, concentrations of the additive in lubricating oils and lubricating oil concentrates range from 0.1 to 50 weight percent.

The hydrocarbon oil in the finished lubricating composition advantageously constitutes at least about 85 weight percent and preferably between about 90 and 98 weight percent of the composition, and in the lube oil concentrates between about 50 and 90 weight percent of the composition. It is to be noted that even in the lubricating oil concentrates the prescribed quaternary ammonium salt will exhibit detergent-dispersancy.

Examples of the hydrocarbon base oil contemplated herein are the naphthenic base, paraffinic bae and mixed base mineral oils, lubricating oils derived from coal products and synthetic oils, e.g., alkylene polymers such as polypropylene and polyisobutylene of a molecular weight of between about 250 and 2500. Advantageously, a lubricating base oil having a lubricating oil viscosity at 100° F. of between about 50 and 1000, preferably between about 100 and 600, are normally employed for the lubricant compositions and concentrates thereof (SUS basis).

In the contemplated finished lubricating oil compositions other additives may be included in addition to the dispersant of the invention. The additives may be any of the suitable standard pour depressants, viscosity index improvers, oxidation and corrosion inhibitors, anti-foamants, supplementary detergent-dispersants, etc. The choice of the particular additional additives to be included in the finished oils and the particular amounts thereof will depend on the use and conditions desired for the finished oil product.

Specific examples of the supplementary additives are as follows:

A widely used and suitable VI improver is the polymethacrylate having the general formula:

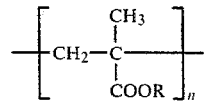

where R is an aliphatic radical of from 1 to 20 carbons and n is an integer of between about 600 and 35,000. One of the most suitable VI improvers is the tetrapolymer of butyl methacrylate, dodecyl methacrylate, octadecyl methacrylate, and dimethylaminoethyl methacrylate having a respective component weight ratio in the polymer of about 4:10:5:1. Another VI improver is a copolymer of ethylene and propylene having a molecular weight of 20,000 to 50,000 containing 30 to 40 percent propylene in the copolymer in admixture with solvent neutral oil comprising 13 weight percent copolymer and 87 weight percent oil. The VI improvers are normally employed in the finished lubricant compositions in quantities between about 0.1 and 10 percent by weight.

One of the commonly employed lube oil corrosion inhibitors and antioxidants are the divalent dialkyl dithiophosphates resulting from the neutralization of a $P_2S_5$-alcohol reaction product with a divalent metal or divalent metal oxide. Barium and zinc dialkyl dithiophosphate are specific examples. Another class of antioxidants are the polyalkylated diphenylamines, such as a mixture of 2,2'-diethyl-4,4'-dioctyldiphenylamine and 2,2'-diethyl-4-octyldiphenylamine. The corrosion and oxidation inhibitors are usually present in the finished lubricating oil compositions in concentrations of between about 0.1 and 3 weight percent.

Examples of supplementary detergent-dispersants which can be employed are the monoethoxylated inorganic phosphorus acid-free, steam hydrolyzed polyalkylene (500–50,000 MW)-$P_2S_5$ reaction product, alkaline earth metal alkylphenolates, such as barium nonylphenolate, barium dodecylcresolate, calcium dodecylphenolate and the calcium carbonate overbased calcium alkaryl sulfonates formed by blowing a mixture of calcium hydroxide and a calcium alkaryl sulfonate, e.g., calcium alkyl benzene sulfonate of about 900 m.w. with carbon dioxide to form a product having a total base number (TBN) of 50 to more, e.g., 300 to 400.

If antifoamants are employed in the finished compositions, one widely used class which is suitable are the dimethyl silicone polymers employed in amounts of between about 10 and 1000 ppm.

The following test was employed to determine the dispersant effectiveness of the lubricant composition of the invention.

BENCH VC TEST

In the Bench VC Test, a mixture containing the test oil and a diluent are heated at an elevated temperature. After heating, the turbidity of the resultant mixture is measured. A low % turbidity (0–10) is indicative of good dispersancy while high results (20–100) are indicative of oils of increasingly poor dispersancy.

EXAMPLE VI

A fully formulated SAE Grade 10W-40 lubricating oil composition containing the quaternary ammonium salt of the invention was tested for its dispersant effectiveness in the Bench VC Test in comparison to a fully formulated base oil without the amine salt dispersant, and to fully formulated lubricating oil compositions containing either a commercial succinimide dispersant or an intermediate product.

The base blend employed contained the following conventional additives:

0.15 weight % zinc as zinc dialkyldithiophosphate
0.23 weight % calcium as overbased calcium sulfonate
0.25 weight % alkylated diphenylamine antioxidant
11.5 weight % ethylene-propylene copolymer VI improver
0.15 weight % ethoxylated alkylphenol
0.10 weight % methacrylate pour depressant
150 ppm silicone antifoamant
mineral oil—balance (viscosity SUS at 100° F. of 120)

The quaternary ammonium salt dispersant of the invention was added to the base blend at several concentration levels on an oil-free basis and then tested in the Bench VC Test.

The results are set forth in the table below:

TABLE I

BENCH VC TEST

| Run | Wt. % of Additive in Base Blend | | Turbidity |
|---|---|---|---|
| 1 | Base Blend (no dispersant) | | 97.5 |
| 2 | Example I | 4.0% | 52.0 |
| 3 | Example II | 5.0% | 31.5 |
| 4 | Example III (extracted product) | 5.0% | 6.5 |
| 5 | Example IV (stripped product) | 4.0% | 6.0 |
| 6 | Example IV (extracted product) | 4.0% | 5.0 |
| 7 | Example IV (extracted product) | 3.0% | 8.5 |
| 8 | Example V (stripped product) | 5.0% | 9.5 |
| 9 | Example V (extracted product) | 5.0% | 9.0 |
| 10 | Commercial Dispersant | 4.0% | 4.0 |
| 11 | Commercial Dispersant | 3.0% | 9.5 |

The foregoing tests demonstrate that the prescribed quaternary ammonium salts of the invention are excellent dispersants for lubricating oil compositions exhibiting an effectiveness equal or superior to that of a commercial lubricating oil dispersant, and exhibiting an effectiveness significantly better than the intermediate pyridine substituted succinimide.

We claim:

1. A quaternary ammonium succinimide salt composition represented by the formula:

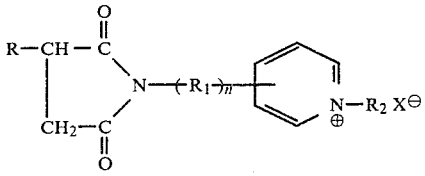

in which R is a hydrocarbyl radical having from 25 to 200 carbon atoms, $R_1$ is a divalent hydrocarbon radical having from 1 to 10 carbon atoms, $R_2$ is a hydrocarbyl radical having from 1 to 10 carbon atoms, n has a value of 0 or 1, and X is a halide radical.

2. A quaternary ammonium succinimide salt composition represented by the formula:

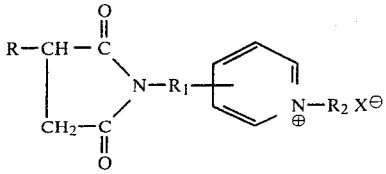

in which R is a hydrocarbon radical having from 50 to 125 carbon atoms, $R_1$ is a methylene or an ethylene radical, $R_2$ is a hydrocarbyl radical having from 1 to 7 carbon atoms and X is a chloride or bromide anion.

3. A quaternary ammonium salt composition represented by the formula:

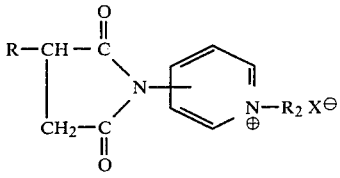

in which R is a hydrocarbon radical having from 50 to 125 carbon atoms, $R_2$ is a hydrocarbyl radical having from 1 to 7 carbon atoms and X is a chloride or a bromide anion.

4. A quaternary ammonium salt composition represented by the formula:

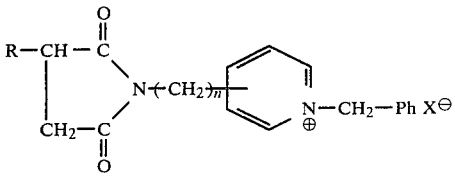

in which R is a hydrocarbyl radical having from 25 to 200 carbon atoms, n is 0 or 1, and X is a chloride anion wherein Ph represents the phenyl group.

5. The compound benzyl 3-(polyisobutenylsuccinimido)pyridinium chloride wherein said polyisobutenyl substituent has a molecular weight of 1300.

6. The compound benzyl 3-(polyisobutenylsuccinimidomethyl)pyridinium chloride wherein said polyisobutenyl substituent has a molecular weight of 1300.

7. A lubricating oil composition comprising a major portion of a mineral lubricating oil and a minor dispersant amount of a quaternary ammonium succinimide salt composition represented by the formula:

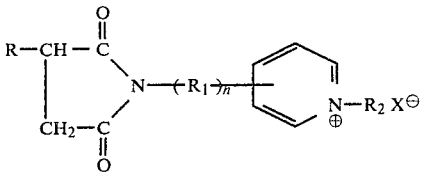

in which R is a hydrocarbyl radical having from 25 to 200 carbon atoms, $R_1$ is a divalent hydrocarbon radical having from 1 to 10 carbon atoms, $R_2$ is a hydrocarbyl radical having from 1 to 10 carbon atoms, n has a value of 0 or 1, and X is a halide radical.

8. A lubricating oil composition comprising a major portion of a mineral lubricating oil and a minor dispersant amount of a quaternary ammonium succinimide salt composition according to claim 1 in which R is a hydrocarbon radical having from 50 to 125 carbon atoms, $R_1$ is a methylene or an ethylene radical, n is 0 or 1, $R_2$ is a hydrocarbyl radical having from 1 to 7 carbon atoms and X is a chloride or bromide anion.

9. A lubricating oil composition according to claim 7 in which said quaternary ammonium salt composition has the formula:

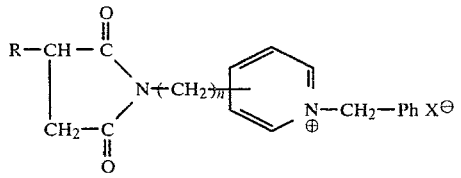

in which R is a hydrocarbyl radical having from 25 to 200 carbon atoms, n is 0 or 1, and X is a chloride anion wherein Ph represents the phenyl group.

10. A lubricating oil composition according to claim 7 in which said quaternary ammonium salt composition is represented by the formula:

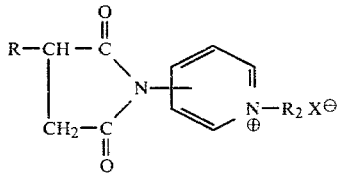

in which R is a hydrocarbon radical having from 50 to 125 carbon atoms, $R_2$ is a hydrocarbyl radical having from 1 to 7 carbon atoms and X is a chloride or a bromide anion.

11. A lubricating oil composition according to claim 7 containing from 0.1 to 10 weight percent of said quaternary ammonium salt composition.

* * * * *